US006976890B2

(12) United States Patent
Saito et al.

(10) Patent No.: US 6,976,890 B2
(45) Date of Patent: Dec. 20, 2005

(54) ELECTRICAL CONNECTOR FOR CONNECTING A MATING CONTACT AND A CONNECTION OBJECT

(75) Inventors: Yosuke Saito, Tokyo (JP); Hiroyuki Tamura, Saitama (JP)

(73) Assignees: Japan Aviation Electronics Industry, Limited, Tokyo (JP); NEC Corporation, Tokyo (JP)

( * ) Notice: Subject to any disclaimer, the term of this patent is extended or adjusted under 35 U.S.C. 154(b) by 0 days.

(21) Appl. No.: 10/866,323

(22) Filed: Jun. 10, 2004

(65) Prior Publication Data

US 2005/0003694 A1 Jan. 6, 2005

(30) Foreign Application Priority Data

Jun. 11, 2003 (JP) ..... 2003-166445

(51) Int. Cl.[7] ..... H01R 9/24
(52) U.S. Cl. ..... 439/891; 439/682
(58) Field of Search ..... 439/891, 861, 439/862, 682, 858, 525, 70, 188

(56) References Cited

U.S. PATENT DOCUMENTS 3,659,243 A * 4/1972 Gluntz ..... 439/525
4,552,423 A * 11/1985 Swengel, Jr. ..... 439/507
5,788,539 A * 8/1998 Fedder ..... 439/682
5,803,757 A * 9/1998 Wang ..... 439/188
5,833,498 A * 11/1998 Smyk ..... 439/682
6,312,287 B1 11/2001 Harting et al.
6,471,365 B2 * 10/2002 Wang et al. ..... 362/84

FOREIGN PATENT DOCUMENTS

EP 0 439 147 A1 * 7/1991
EP 1 315 252 5/2003
JP H5-1185 U 1/1993

* cited by examiner

*Primary Examiner*—Tho D. Ta
(74) *Attorney, Agent, or Firm*—Collard & Roe, P.C.

(57) ABSTRACT

An electrical connector has a conductive contact which has a main contacting portion to be connected to a conductive mating contact and a terminal portion to be connected to a connection object, and an insulator holding the contact. The contact is divided into a first contact part having the main contacting portion and a second contact part having the terminal portion. The first contact part has a spring portion to be brought into elastic contact with the second contact part. The first contact part is held by the insulator to be independently removable.

10 Claims, 2 Drawing Sheets

ELECTRICAL CONNECTOR FOR CONNECTING A MATING CONTACT AND A CONNECTION OBJECT

This application claims priority to prior Japanese patent application JP 2003-166445, the disclosure of which is incorporated herein by reference.

BACKGROUND OF THE INVENTION

This invention relates to an electrical connector for connecting a mating contact and a connection object and, in particular, to an electrical connector for use in power connection in an electronic apparatus such as a mobile telephone.

For example, Japanese Utility Model Application Publication (JP-U) No. H5-1185 discloses an electrical connector comprising a front housing part and a rear housing part integrally fixed to each other by screws.

To the front housing part, a front contact is attached. The front contact has a connecting portion formed at its front end and an elastic contacting portion formed at its rear end. The elastic contacting portion has a free end provided with a contact point.

To the rear housing part, a rear contact is attached. The rear contact has a terminal portion and a contacting portion. The rear housing part is fixed to a substrate by passing the terminal portion of the rear contact through a through hole formed in the substrate and soldering the terminal portion to a back surface of the substrate.

The contact point of the front contact and the contacting portion of the rear contact are brought into elastic contact with each other so that the front contact and the rear contact are electrically connected.

However, the electrical connector disclosed in the above-mentioned publication is disadvantageous in the following respects. In case where the front contact attached to the front housing part has a defect such as corrosion or contamination, the front contact must be exchanged. In an exchanging operation of the front contact, the front housing part is removed from the rear housing part. Then, the front contact is removed from the front housing part and replaced by a new front contact. Finally, the front housing is fixed to the rear housing by the screws to assemble the connector again. Thus, the exchanging operation is complicated and troublesome.

In the exchanging operation of the front contact, the connector must be assembled again fully taking into account a positional accuracy of a portion where the contact point of the front contact and the contacting portion of the rear contact are contacted with each other after assembling. Thus, it is troublesome and time consuming to assemble the connector.

SUMMARY OF THE INVENTION

It is therefore an object of this invention to provide an electrical connector which is capable of easily exchanging a contact having a defect such as corrosion or contamination and of improving a workability in an exchanging operation.

According to this invention, there is provided an electrical connector comprising a contact which has a main contacting portion to be connected to a conductive mating contact and a terminal portion to be connected to a connection object, and an insulator holding the contact, wherein the contact is divided into a first contact part having the main contacting portion and a second contact part having the terminal portion, at least one of the first and the second contact parts having a spring portion to be brought into elastic contact with the other; the first contact part being held by the insulator to be independently removable.

DESCRIPTION OF THE PREFERRED EMBODIMENT

Figure 1:
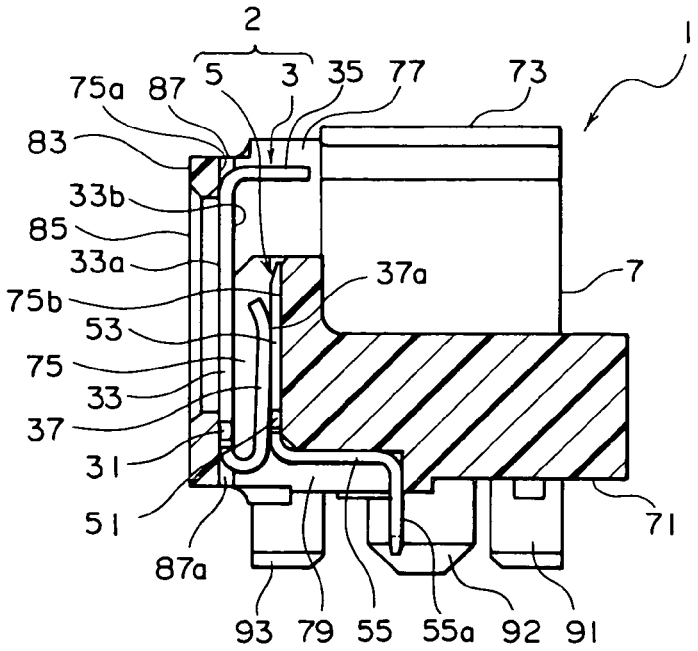
FIG. 1 is a vertical sectional view of an electrical connector according to a first embodiment of this invention.

Now, description will be made of embodiments of this invention with reference to the drawing.

Referring to FIG. 1, an electrical connector 1 according to a first embodiment of this invention comprises a conductive contact 2 which has a first contact part 3 and a second contact part 5, and an insulator 7 holding the contact 2.

Thus, the contact 2 is divided into the first contact part 3 and the second contact part 5 separate from each other and individually held by the insulator 7.

The first contact part 3 is held by the insulator 7 so as to be independently removable from the insulator 7.

Figure 2:
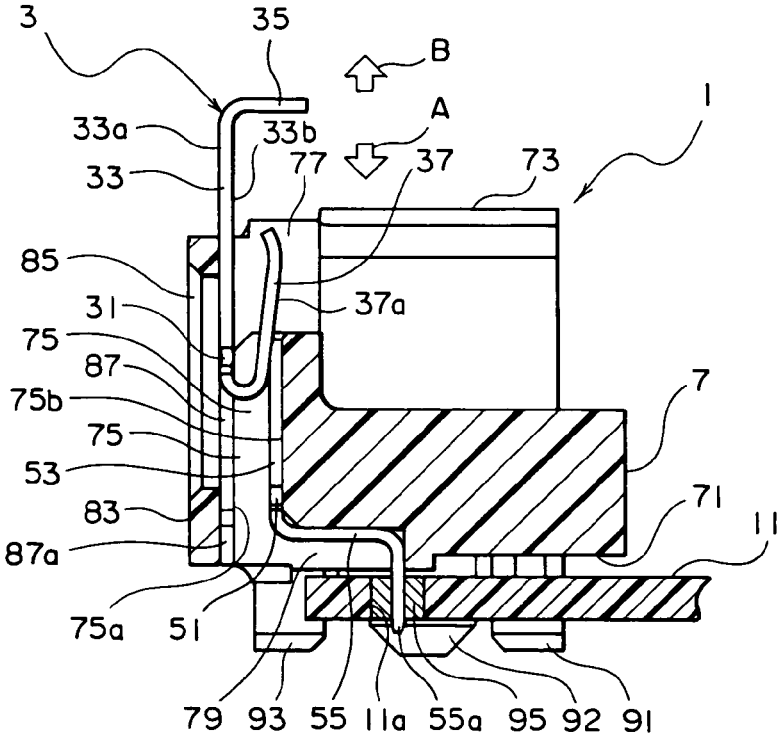
FIG. 2 is a vertical sectional view of the electrical connector in FIG. 1 in the middle of an operation of fixing a first contact part to an insulator after the electrical connector is mounted to a substrate.

Referring to FIG. 2, the electrical connector 1 is mounted to a substrate 11, such as a printed wiring board, as a connection object. FIG. 2 shows a state in the middle of an operation of fixing the first contact part 3 to the insulator 7.

Each of the first and the second contact parts 3 and 5 is formed by press-punching a conductive plate to obtain a long strip-like conductive plate and then bending the strip-like conductive plate.

The first contact part 3 has a first holding portion 31 held by the insulator 7, a first contacting portion (main contacting portion) 33 extending from one end of the first holding portion 31, an operating portion 35 extending from an extending end of the first contacting portion 33, and a spring portion 37 bent from the other end of the first holding portion 31 and extending to face the first contacting portion 33.

The first contacting portion 33 has one surface 33*a* as a contact surface to be contacted with a conductive mating contact (not shown). The first holding portion 31 and the spring portion 37 are connected to each other at a portion having a generally U-shaped curve in a side view. The spring portion 37 extends to a position corresponding to an intermediate portion of the first contacting portion 33 in a longitudinal direction and faces the other surface 33*b* of the first contacting portion 33 opposite to the one surface 33*a*. The spring portion 37 has an elastic force in a direction away from the other surface 33*b* of the first contacting portion 33. The spring portion 37 has one surface 37*a* near its end. The one surface 37*a* faces the first contacting portion 33 and is adapted to be brought into contact with the second contact part 5 as will later be described.

The operating portion 35 is bent from the extending end of the first contacting portion 33 in a direction intersecting a plate plane of the first contacting portion 33. In this embodiment, the operating portion 35 is bent to be substantially perpendicular to the first contacting portion 33.

The second contact part 5 has a second holding portion 51 held by the insulator 7, a second contacting portion (local contacting portion) 53 extending from one end of the second holding portion 51, and a terminal portion 55 extending from the other end of the second holding portion 51 to the outside of the insulator 7.

The second contacting portion 53 faces the spring portion 37 and is adapted to be brought into contact with the spring portion 37. The terminal portion 55 is bent from the other end of the second holding portion 51 to be generally perpendicular to the second holding portion 51 in a side view, and extends in a direction substantially parallel to the second contacting portion 53 and opposite to the second contacting portion 53. Thus, the second contact part 5 has a generally crank-like shape in a side view.

The insulator 7 has a first surface 71 as a lower surface faced to and mounted to the substrate 11, a second surface 73 as an upper surface opposite to the first surface 71, and first through third receiving portions 75, 77, and 79 communicating with one another and defining an opening between the first and the second surfaces 71 and 73 in a vertical direction.

Specifically, the first through the third receiving portions 75, 77, and 79 form the opening as a bore extending between the first and the second surfaces 71 and 73 in an inserting direction A and a removing direction B opposite to the inserting direction A. The inserting direction A and the removing direction B are depicted by arrows in FIG. 2. In the first, the second, and the third receiving portions 75, 77, and 79, the first contact part 3, the second contacting portion 53 of the second contact part 5, and the terminal portion 55 of the second contact part 5 except a terminal end 55*a* thereof are received. The terminal end 55*a* of the terminal portion 55 extends out of the first surface 71 of the insulator 7.

Between the first and the second surfaces 71 and 73 of the insulator 7, the first receiving portion 75 has a long dimension in the inserting and the removing directions A and B, i.e., in the vertical direction in FIG. 2. The second receiving portion 77 is located above the first receiving portion 75 and communicates with the first receiving portion 75. The second receiving portion 77 is adapted to receive the operating portion 35. The third receiving portion 79 is located below the first receiving portion 75 and communicates with the first receiving portion 75.

The insulator 7 is provided with a window portion 85 opened in a vertical outer wall 83 and faced to the one surface 33*a* of the first contacting portion 33. The window portion 85 communicates with the first receiving portion 75. The contacting portion 33 is located to close the window portion 85.

In the first receiving portion 75, the first holding portion 31, the first contacting portion 33, and the spring portion 37 of the first contact part 3 are placed. The operating portion 35 of the first contact part 3 extends into the second receiving portion 77.

In the first receiving portion 75, the second holding portion 51 and the second contacting portion 53 of the second contact part 5 are placed. The third receiving portion 79 receives the terminal portion 55 except the terminal end 55*a*. As described above, the terminal end 55*a* of the terminal portion 55 extends from the third receiving portion 79 out of the first surface 71 of the insulator 7.

Most part of the first contacting portion 33 of the first contact part 3 in the longitudinal direction is fixed to the insulator 7 with the one surface 33*a* of the first contacting portion 33 exposed to the window portion 85. The window portion 85 is adapted to receive the mating contact to bring the mating contact into contact with the one surface 33*a* of the first contacting portion 33.

The outer wall 83 forming the first receiving portion 75 has an inner wall surface provided with a pair of guide grooves 87 extending in the vertical direction along one wall surface 75*a* of the first receiving portion 75 and arranged in parallel to each other. The first holding portion 31 is engaged with the guide grooves 87. The guide grooves 87 serve to guide the first contact part 3 in the inserting direction A or the removing direction B. The first receiving portion 75 has the other wall surface 75*b* faced to the one wall surface 75*a*. The second holding portion 51 and the second contacting portion 53 of the second contact part 5 are placed on the other surface 75*b* in contact therewith. In the first receiving portion 75, the spring portion 37 of the first contact part 3 is brought into elastic contact with the second contacting portion 53 of the second contact part 5.

The first surface 71 of the insulator 7 is provided with a plurality of bosses 91, 92, and 93 protruding from the first surface 71. Each of the bosses 91, 92, and 93 is inserted into a positioning hole (not shown) or a positioning cutout (not shown) formed in the substrate 11 illustrated in FIG. 2 and serves to position the insulator 7.

Next, an assembling operation of the electrical connector 1 will be described. At first, a through hole 11*a* is formed in the substrate 11 to receive the terminal end 55*a* of the terminal portion 55 of the second contact part 5 inserted in the inserting direction A. The terminal end 55*a* of the terminal portion 55 is soldered and connected by a solder 95 after it is inserted into the through hole 11*a*.

The second contact part 5 is received in the first and the third receiving portions 75 and 79 of the insulator 7 to be fixed. Thereafter, the terminal end 55*a* of the terminal portion 55 is soldered and connected to a conductive pattern (not shown) formed on the substrate 11. The first contact part 3 with the first holding portion 31 directed forward (i.e., downward in the figure) is inserted from the second receiving portion 77 into the guide grooves 87 in the inserting direction A by pressing the operating portion 35 downward. The first contact part 3 is further pressed and moved in the inserting direction A along the guide grooves 87. At this time, the spring portion 37 is forced into the first receiving portion 75 with an elastic force. Specifically, the spring portion 37 is pressed towards the first contacting portion 33 and kept in frictional contact with the second contacting portion 53.

When the first contact part 3 is forced downward to a holding position in the first receiving portion 75, the first holding portion 31 is butted to a pair of stoppers 87*a* formed in the guide grooves 87 and the first contact part 3 is prevented from being further pressed downward.

In case where the first contact part 3 has a defect such as corrosion or contamination, the first contact part 3 must be exchanged. In this event, the first contact part 3 is removed from the insulator 7 by pulling up the operating portion 35 in the removing direction B. Instead, a new first contact part 3 is inserted into the first receiving portion 75 of the insulator 7. Thus, the first contact part 3 can be exchanged.

Figure 3:
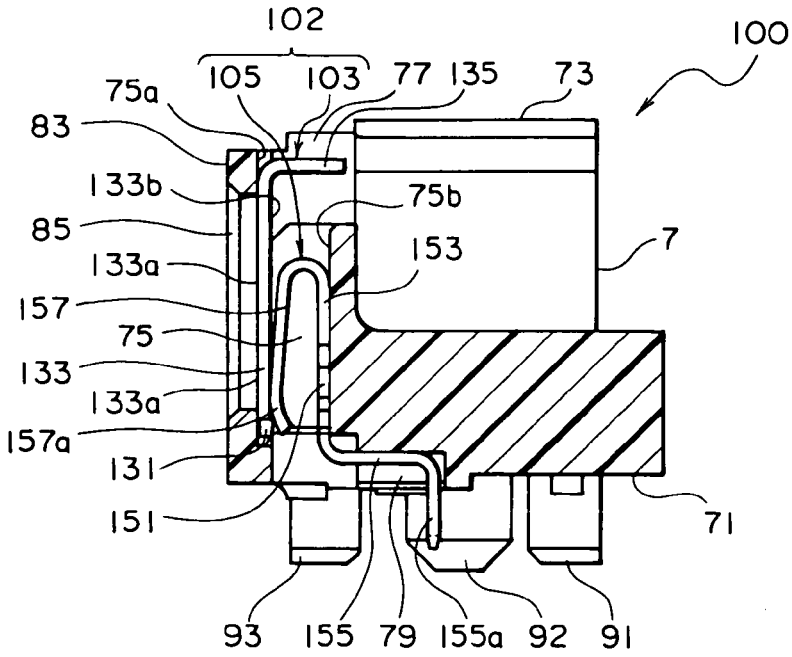
FIG. 3 is a vertical sectional view of an electrical connector according to a second embodiment of this invention.
Figure 4:
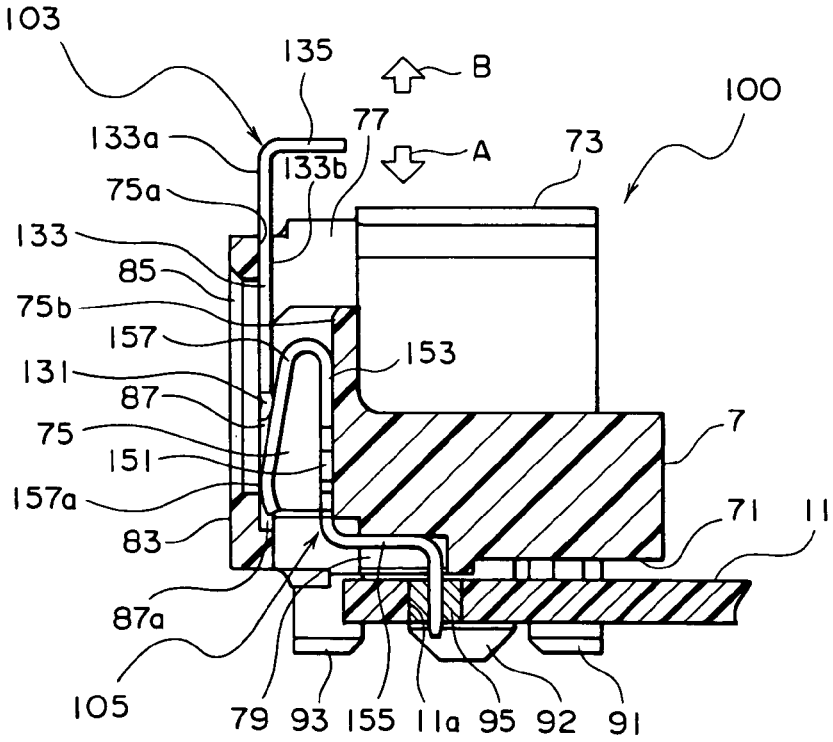
FIG. 4 is a vertical sectional view of the electrical connector in FIG. 3 in the middle of an operation of fixing a first contact part to an insulator after the electrical connector is mounted to a substrate.

Referring to FIGS. 3 and 4, an electrical connector 100 according to a second embodiment of this invention will be described.

The insulator 7 and the substrate 11 illustrated in FIGS. 3 and 4 are substantially similar in structure to those of the first embodiment described in conjunction with FIGS. 1 and 2. Therefore, those similar parts are depicted by like reference numerals and description thereof will be omitted.

As illustrated in FIGS. 3 and 4, the contact 102 has a first contact part 103 removably held by the insulator 7 and a second contact part 105 held by the insulator 7.

Thus, the contact 102 is divided into the first contact part 103 and the second contact part 105 separate from each other and individually held by the insulator 7. The first contact part 103 is held by the insulator 7 so as to be independently removable from the insulator 7.

Each of the first and the second contact parts 103 and 105 is formed by press-punching a conductive plate to obtain a long strip-like conductive plate and then bending the strip-like conductive plate.

The first contact part 103 has a first holding portion 131 held by the insulator 7, a first contacting portion (main contacting portion) 133 extending from one end of the first holding portion 131, and an operating portion 135 extending from an extending end of the first contacting portion 133 and bent to be substantially perpendicular to the first contacting portion 133.

The first contacting portion 133 has one surface 133*a* adapted to be brought into contact with a conductive mating contact (not shown).

The second contact part 105 has a second holding portion 151 held by the insulator 7, a second contacting portion (local contacting portion) 153 extending from one end of the second holding portion 151, a terminal portion 155 extending from the other end of the second holding portion 151 to the outside of the insulator 7, and a spring portion 157 bent from an extending end of the second contacting portion 153 and extending to face the second holding portion 151.

The spring portion 157 has one surface 157*a* near its end. The one surface 157*a* faces the first contacting portion 133 and is brought into contact with the first contacting portion 133. The terminal portion 155 is bent from the second holding portion 151 to be generally perpendicular thereto in a side view and further extends in a direction substantially parallel to the second holding portion 151 and opposite to the second holding portion 151. Thus, a part of the second contact part 105 except the spring portion 157 has a generally crank-like shape in a side view.

The second holding portion 151 and the spring portion 157 are connected to each other at a portion having a generally U-shaped curve in a side view. The spring portion 157 has an elastic force in a direction away from the second holding portion 151 and is kept in contact with the other surface 133*b* of the first contacting portion 133.

In the first receiving portion 75 of the insulator 7, the first holding portion 131 and the second contacting portion 133 of the first contact part 103 are placed. The operating portion 135 of the first contact part 103 is received in the second receiving portion 77. In the first receiving portion 75, the second holding portion 151 and the spring portion 157 of the second contact part 105 are placed. The third receiving portion 79 receives the terminal portion 155 except its terminal end 155*a*. The terminal end 155*a* of the terminal portion 155 extends from the third receiving portion 79 out of the first surface 71 of the insulator 7.

Most part of the first contacting portion 133 of the first contact part 103 in the longitudinal direction is fixed to the insulator 7 with the one surface 133*a* of the first contacting portion 133 exposed to the window portion 85 formed in the insulator 7. In the first receiving portion 75, the spring portion 157 of the second contact part 105 is brought into elastic contact with the first contacting portion 133 of the first contact part 103.

Next, an assembling operation of the electrical connector 100 according to the second embodiment will be described. At first, the second contact part 105 is received in the first and the second receiving portions 75 and 79 and fixed to the insulator 7. Thereafter, the terminal end 155*a* of the terminal portion 155 is inserted into the through 11*a* of the substrate 11 and soldered and connected by the solder 95. Then, the first contact part 103 with the first holding portion 131 directed forward is inserted from the second receiving portion 77 into the guide grooves 87. By moving the operating portion 135 in the inserting direction A, the first contact part 103 is forced downward in the inserting direction A along the guide grooves 87. At this time, the first contact part 103 presses the spring portion 157 towards the second holding portion 151. It is noted here that, in a natural state, an end portion of the spring portion 157 is located in the guide grooves 87. The first contacting portion 133 is forced downward in frictional contact with the spring portion 157. When the first contact part 103 is pressed downward to a predetermined position in the first receiving portion 75, the first holding portion 131 is butted to the stoppers 87*a* formed in the guide grooves 87 and the first contact part 103 is inhibited from being further pressed.

In case where the first contact part 103 has a defect such as corrosion or contamination, the first contact part 103 must be exchanged. In this event, the first contact part 103 is removed from the insulator 7 by pulling up the operating portion 135 in the removing direction B. Instead, a new first contact part 103 is fixed to the insulator 7. Thus, exchange is carried out.

In the first and the second embodiments, the substrate 11 is described as a connection object. Alternatively, the connection object may be a cable instead of the substrate 11. Thus, this invention is also applicable to an electrical connector for soldering and connecting a cable to the terminal end 55*a* or 155*a* of the terminal portion 55 or 155.

As described above, in each of the electrical connectors 1 and 100, each of the first contact parts 3 and 103 is removably held by the insulator 7 and received in the first receiving portion 75. Therefore, it is possible to easily exchange the first contact part 3 or 103 having a defect such as corrosion or contamination.

In order to exchange the first contact part 3 or 103 with a new first contact part, the first contact part 3 or 103 having a defect is removed from the insulator 7. Then, by moving the operating portion 35 or 135 of the new first contact part 3 or 103 in the inserting direction A to force the first contact part 3 or 103 downward in the inserting direction A along the guide grooves 87, exchange is carried out.

Therefore, it is possible to easily achieve a positional accuracy at a contacting portion between the first contacting portion 3 or 103 and the second contacting portion 5 or 105 after assembling and to improve a workability in assembling operation.

What is claimed is:

1. An electrical connector comprising a contact which has a main contacting portion to be connected to a conductive mating contact and a terminal portion to be connected to a connection object, and an insulator holding the contact, wherein:

said contact is divided into a first contact part having said main contacting portion and a second contact part having said terminal portion, at least one of said first and said second contact parts having a spring portion to be brought into elastic contact with the other;

said insulator having a first receiving portion receiving said first contact part and said second contact part except said terminal portion;

said second contact part having a local contacting portion extending from one end of said second holding portion and faced to said main contacting portion;

said first contact part being held by said insulator to be independently removable;

said main contacting portion and said local contacting portion facing each other in said first receiving portion, said main contacting portion having one surface as a contact surface to be brought into contact with said mating contact;

said local contacting portion being faced to the other surface of said main contacting portion opposite to the one surface, said insulator having a window portion formed in an outer wall thereof and faced to the one surface of said main contacting portion, said window portion being opened so as to bring said mating contact into contact with the one surface of said main contacting portion; and said window portion communicating with said first receiving portion.

2. An electrical connector according to claim 1, wherein said insulator has a third receiving portion receiving said terminal portion, said third receiving portion communicating with said first receiving portion, said terminal portion extending from said third receiving portion to the outside of said insulator.

3. An electrical connector according to claim 1, wherein said first contact part is held by said insulator so as to be inserted and removed in an inserting direction and a removing direction opposite to the inserting direction; and said first contact part further having a first holding portion held by said insulator in said receiving portion, said holding portion having one end connected to said main contacting portion.

4. An electrical connector according to claim 3, wherein said spring portion extends from the other end of said first holding portion to face the other surface of said main contacting portion.

5. An electrical connector according to claim 1, wherein said second contact part has a second holding portion held by said insulator in said first receiving portion, said second holding portion having the other end connected to said terminal portion.

6. An electrical connector according to claim 5, wherein said spring portion extends from the other end of said second holding portion to face said local contacting portion.

7. An electrical connector according to claim 3, wherein said first receiving portion has a guide groove formed on its inner wall surface and adapted to be engaged with said first holding portion to guide the movement of said first contact part in said inserting direction and said removing direction.

8. An electrical connector according to claim 7, wherein said guide groove is provided with a stopper for inhibiting the movement of said first contact part inserted into said first receiving portion and moved in said first receiving portion when said first contact part reaches a holding position.

9. An electrical connector according to claim 1, wherein said first contact part has an operating portion bent from an extending end of said main contacting portion in a direction intersecting an extending direction of said main contacting portion.

10. An electrical connector according to claim 9, wherein said insulator has a second receiving portion receiving said operating portion, said second receiving portion communicating with said first receiving portion.

* * * * *